United States Patent [19]

Bencriscutto

[11] Patent Number: 4,752,075

[45] Date of Patent: Jun. 21, 1988

[54] GOLF CLUB GRIP TRAINING AID

[76] Inventor: Michael Bencriscutto, 6121 Golf Ridge Dr., Racine, Wis. 53402

[21] Appl. No.: 944,873

[22] Filed: Dec. 22, 1986

[51] Int. Cl.[4] ..... A63B 69/36

[52] U.S. Cl. ..... 273/183 B; 273/166; 273/189 R

[58] Field of Search ..... 273/165, 166, 183 B, 273/188 R, 189 R, 189 A; 2/161 A

[56] References Cited

U.S. PATENT DOCUMENTS

| | | | |
|---|---|---|---|
| 2,474,030 | 6/1949 | Braswell | 273/166 |
| 2,782,422 | 2/1957 | Bencriscutto | 273/166 X |
| 3,725,957 | 4/1973 | Shotmeyer | 2/161 A |

*Primary Examiner*—George J. Marlo

*Attorney, Agent, or Firm*—James E. Nilles

[57] ABSTRACT

A golf training band or glove made of flexible material and which can be wrapped around one hand of the golfer and held securely in place by Velcro, for example, which is secured to the two overlapping ends of the band or glove. The band or glove has a large aperture in which the thumb of the one hand of the golfer is inserted and also has a first flexible loop secured to the band or glove for snugly receiving the thumb of the player's other hand. A second flexible loop is also provided and which receives the large middle finger of the player's second hand. This training band-like glove indicates to the golfer when his grip or swing is incorrect because of the tension created on either or both of the loops by the pull of the golfer's thumb or large finger.

12 Claims, 3 Drawing Sheets

GOLF CLUB GRIP TRAINING AID

BACKGROUND OF THE INVENTION

The present invention relates to a golf training aid such as a glove or band of flexible material which is worn by one hand of a golfer, for instance, on the right hand of a right-handed golfer, and for the purpose of training the golfer to keep his hands positioned correctly in respect to one another on the golf club.

The present invention is in the nature of an improvement over U.S. Pat. No. 2,782,422, which issued Feb. 26, 1957 and which teaches the use of a glove for the right hand of a right-handed golfer, which glove has an additional thumb portion secured to the palm of the glove that receives the thumb of the left hand of the golfer. While that glove did perform the functions for which it was designed, it did not ensure that the golfer would be reminded to hold his hands completely in the proper position relative to one another and would not indicate to the golfer when his left hand, for example, was opening up, particularly on the back swing, thereby tending to open up the face of the club.

Another example of the prior art is shown in the patent to Antonious U.S. Pat. No. 3,255,462, which issued June 14, 1966 which discloses a golf glove having a selectively attachable elastic band that may or may not be received around the base of the player's thumb.

Still another example of the prior art is shown in the patent to Roessler U.S. Pat. No. 2,852,779, issued Sept. 23, 1958, showing a strap 11 for holding the grip portion of a golf club against the player's hand.

U.S. Pat. No. 3,725,957, issued Apr. 10, 1973, to Shotmeyer, provides a single glove structure for both hands.

SUMMARY OF THE INVENTION

The present invention provides a golf training aid comprising a band or glove of flexible material which is formed with an aperture for receiving the thumb of one hand of a player and which is then wrapped around the one hand. The band or glove has two overlapping ends which are securely held together by suitable means such as Velcro and thus the band or glove can be snugly but releasably wrapped the palm, back, outer edge and inner edge of the hand of the golfer. A first flexible loop preferably of elastic material is secured to the palm of the band or glove and is located adjacent the thumb aperture for snugly receiving the thumb of the player's other hand. A second flexible loop also preferably of elastic material is secured to the glove and is located adjacent the outer edge of the first hand, whereby the second loop is arranged to receive the large middle finger of the player's second hand when the hands are gripping a golf club. A more specific aspect of the invention relates to a band or glove of the above type in which the two flexible loops each have an imaginary axis extending therethrough which are parallel to one another to permit proper and easy access of the middle finger in the second loop and which results in the proper relative positioning of the hands.

Another more limited aspect of the invention relates to a band or glove of the above type in which the outer ends of the loops, that is the ends of the loops located at the outer portion of the player's hand, lie along a common line to thereby properly ensure positioning of the hands relative to one another.

The invention provides a band or glove of the above type which instinctively indicates to the golfer when he is not maintaining his hands in proper relative position to one another. This is accomplished by causing the player to sense when either the thumb or middle finger of the left hand (when used by a right-handed golfer) is pulling or stretching the loops. When this pulling or stretching begins to occur, it indicates to the golfer that he is making a mistake in the relative positioning of his hands and in his golf swing. In other words, the two loops tend to tell the golfer when he is opening up his grip improperly, that is to say if his hands are in effect splitting or coming apart from one another. The golfer then automatically corrects this when he feels this pull on the loops and corrects his swing by eliminating the pulling on the loops.

DESCRIPTION OF A PREFERRED EMBODIMENT

Figure 2:
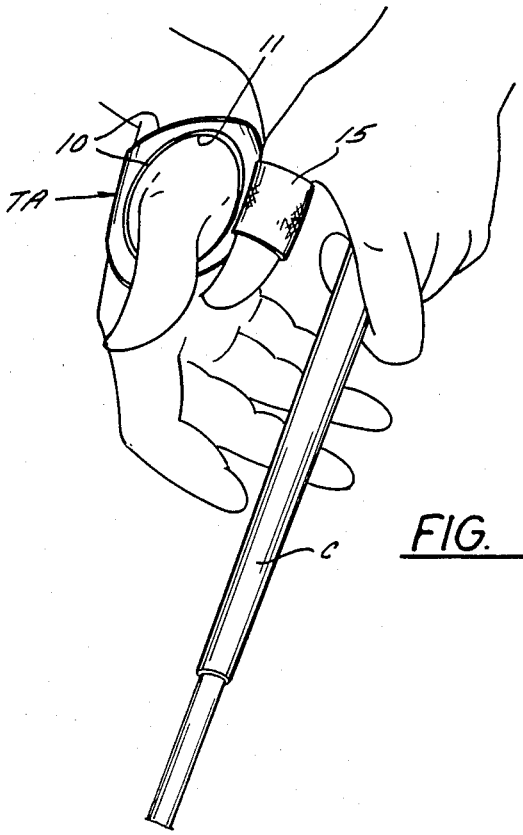
FIG. 2 is a view of the band or glove on the right hand of the golfer and with the left thumb of the golfer fully inserted in the flexible loop located in the palm of the right hand and prior to the completion of the grip on the club.
Figure 3:
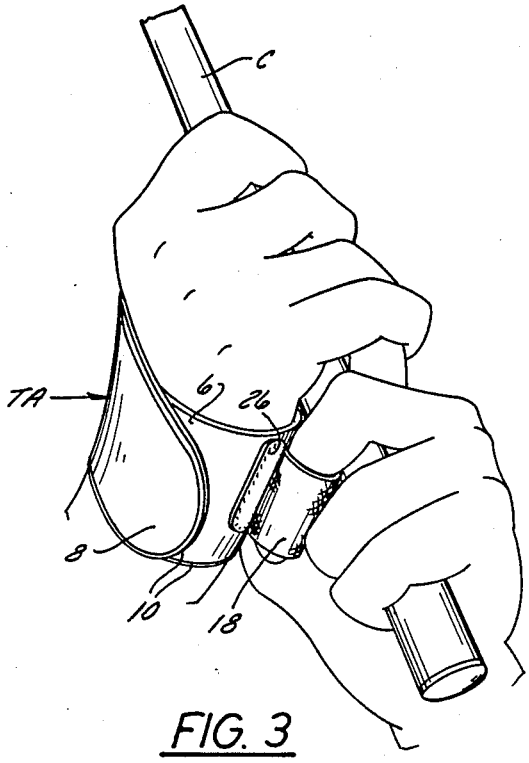
FIG. 3 is another perspective view of the glove showing the large middle finger of the left hand inserted into the second flexible loop of the glove and furthermore showing the hands in their proper club gripping relationship to one another and in a raised position.
Figure 4:
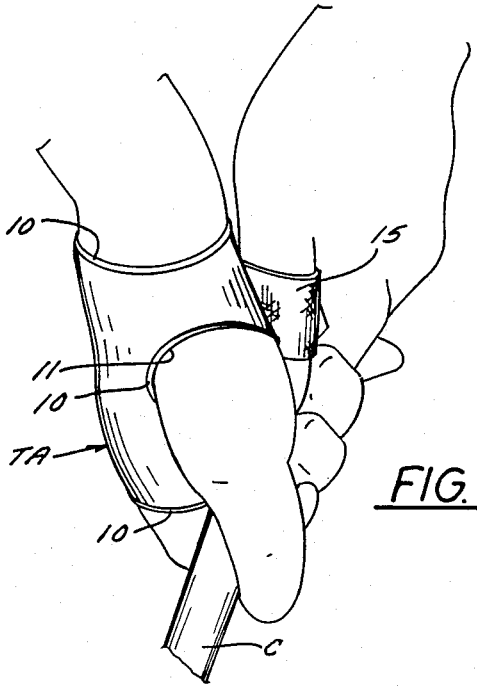
FIG. 4 is another perspective view of the glove on the right hand of the golfer showing the left hand of the golfer with its thumb fully inserted in one loop on the glove and when the hands are in proper club gripping relationship and the club is in a down position.

The present invention will be shown and described when used by a right-handed golfer, but it will be understood that the invention is equally applicable to a left-handed golfer. The general operation of the band or glove provided by the present invention is to place it on the right hand by first inserting the thumb of the right hand through the aperture in the band or glove and then wrapping the glove tightly around the hand and holding it securely in place, for example, by Velcro means on each end of the glove or band. As shown in FIG. 2, the left thumb of the golfer is then inserted in the first loop of the glove and the large middle finger of the golfer is then inserted in the second loop of the glove as shown in FIG. 3, the hands of the golfer then being in the proper club holding relationship as also shown in FIG. 4. The teaching aid TA in the form of such band or glove and provided by the present invention causes the golfer to cooperate with the glove, that is, teaching the golfer not to stretch or pull on the loops during his swing. If the two hands act as one during the swing, the band or glove will feel comfortable and will not stretch. This teaches the golfer to keep his hands positioned and because of this positioning it instructs the golfer relative to his swing and the second loop causes the golfer to hold his left hand in tight gripping engagement with the club and prevents losing control of the club.

Figure 1:
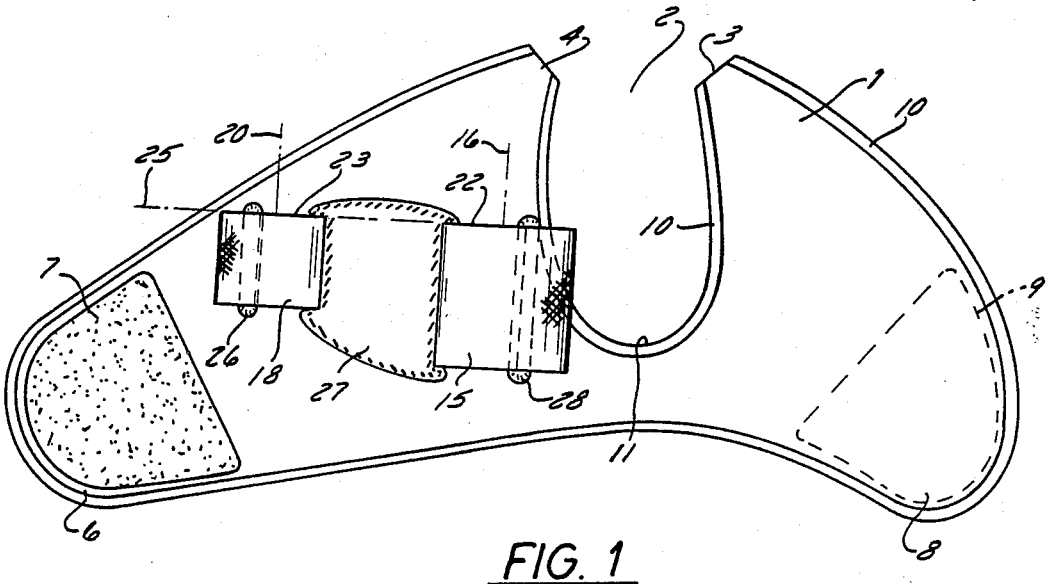
FIG. 1 is a view of the band or glove showing a portion of it cut away and before the band or glove is sewed back together to form a curved bow portion that can fit smoothly around the inner edge and thumb of the hand.
Figure 6:
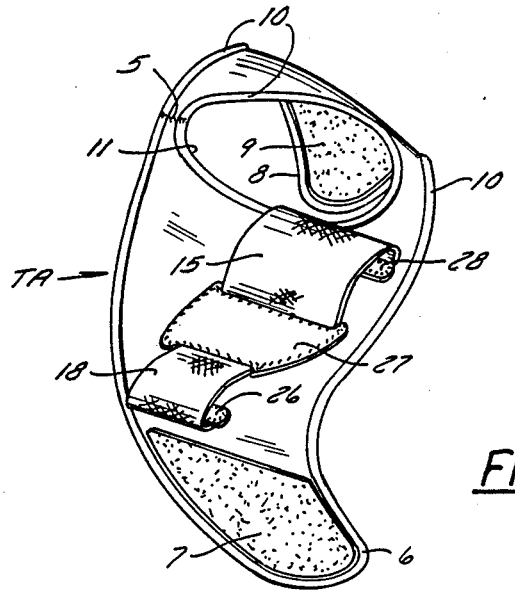
FIG. 6 is a perspective view of the band or glove.

Referring in more detail to the construction and operation of the band or glove provided by the present invention, it is formed of a flexible and durable material which is tough and resistant to wear and tear, an example of such material being a closely woven hard fiber material. As shown in FIG. 1, the band or glove is preferably fabricated from a band of flat material 1 which originally is cut away in the area 2 to provide spaced apart edges 3 and 4. These edges are then overlapped with one another and sewn together to form a joint 5 (FIG. 6) and which results in the band being curved or bowed in the area of the thumb and inner edge of the hand, thereby permitting the band to be snugly and smoothly wrapped around that portion of the hand.

Figure 5:
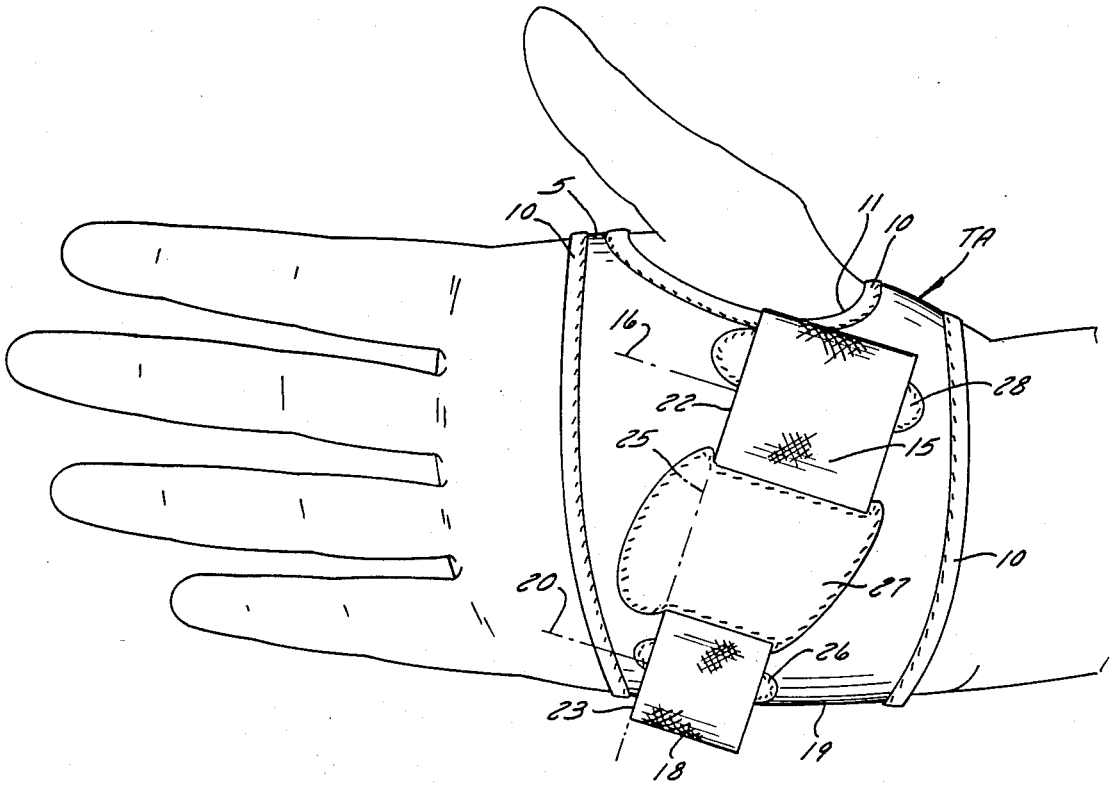
FIG. 5 is a view of the golfer's open right hand showing the band or glove wrapped therearound.

As shown in FIG. 5, the curved or bowed area, when the training aid is being worn, defines an opening which constitutes a finger receiving means for accommodating the fingers of the right hand therethrough. One end 6 of the band has fastening means such as Velcro 7 (FIGS. 1 and 6) sewn thereon while the other end of the band 8 has another piece of Velcro 9 secured to the opposite side of the band. Thus, when the band is wrapped snugly around the hand, the Velcro portions 7 and 9 interengage thereby locking the band on the hand.

A cloth binding 10 is sewn around the periphery of the glove to strengthen it and give it a finished appearance.

An aperture 11 is formed in the band and acts as a first thumb receiving means to receive the thumb of the right hand (of a right-handed golfer). This aperture is sufficiently large so as to permit the band to be pulled up tightly around the base of the thumb.

A first flexible loop 15 constituting a second thumb receiving means, preferably made of heavy elastic material, is sewn to the outside of the band adjacent the thumb aperture and has an imaginary longitudinal axis 16 (FIGS. 1 and 5) extending generally therethrough. This loop 15 is of such size so as to snugly receive the left thumb of the golfer and this left thumb is thrust fully into the loop when in proper position.

A second flexible and elastic loop 18 (FIGS. 1, 3, 5 and 6), constituting a second finger receiving means, is also sewn to the outside of the band or glove and is located to be in adjacent opposed relation to the outer edge 19 (FIGS. 3 and 5) of the first hand of the golfer (the right hand of the right-handed golfer) when the band or glove is properly located on the golfer's right hand. This second loop also has a longitudinal axis 20 (FIGS. 1 and 5) extending therethrough and it should be noted that axis 16 and 18 are parallel to one another. It should also be noted that loops 15 and 18 each have, respectively, an outer edge 22 and 23 (FIGS. 1 and 5), respectively, which lie along an imaginary common line 25. With this construction and relative positioning of the loops, the middle finger of the second hand can be easily and completely inserted into the second loop from the outer edge thereof as shown in FIG. 3 when the hands are properly positioned relative to each other to grasp the club.

Pads 26, 27 and 28 (FIGS. 1, 5 and 6) of material such as soft suede leather are sewn over the juncture of the loops and material 1, and this construction forms a strong joint therebetween. The large pad 27 embraces the club handle and enhances the golfer's grip.

When so arranged, these loops do not force the golfer's hands to remain in the correct position, but they indicate to the golfer when his grip and/or swing are incorrect because of the tension created in them by the pull of the golfer's fingers. Stated otherwise, if the grip on the club C is not correct, the golfer will sense the pulling on the loops and will correct his grip and swing when he feels the pull or tension on the loops.

When the hands are in proper club gripping relationship, the two hands will act as one during the swing and the band or glove will feel comfortable and not stretched. The golfer, in other words, cooperates so to speak with the glove and doesn't stretch it during the swing. The moment the golfer begins to feel his finger is pulling or the thumb is pulling on the respective elastic loop, thereby trying to stretch the loop, the golfer is alerted to the fact that he is beginning to make a mistake in his swing; that is to say, he automatically realizes that he doesn't have the correct swing, and the golfer then begins to eliminate this stretching or trying to pull on the elastic loops. For instance, during the back swing of the club, the golfer can feel the pull on the elastic loop 15 with his left thumb if he is tending to open up the face of the club. At the top of the backward swing, the pull on either or both of the two loops will indicate to the golfer if he, for example, is opening up on his grip, if he is trying to open up on his grip, or if his hands are, in effect, opening up or "splitting" relative to one another. He will then automatically correct his swing when he feels this by eliminating the pulling on the elastic.

Thus, the loops provided by the present invention do not force the golfer's hands to remain in the correct position, but they only indicate to the golfer, because of the tension of them, that his grip or swing are not correct and he will then subconsciously correct his grip and swing.

I claim:

1. A golf training aid to be worn only on one hand of a player, said hand having fingers, including a middle finger, a thumb, a palm, a back, an outer edge and an inner edge, said training aid comprising; an elongated band of flexible material having first and second ends and an aperture therethrough for receiving the thumb of one hand of said player, said band having a length sufficient to permit said band to be wrapped around said one hand leaving said fingers and thumb exposed; fastening means on each of said ends to hold said band snugly but releasably wrapped around said palm, back, outer edge and inner edge of said one hand; a first flexible loop secured to said band adjacent said aperture in a location to be in opposed relation to said palm when said training aid is being worn, for snugly receiving therein the thumb of said player's other hand;

and a second flexible loop secured to said band and located in spaced relation to said first loop in a position to be in opposed relation to said outer edge of said one hand when said training aid is being worn, said second loop sized to snugly receive therethrough only said player's middle finger of said other hand when said one hand and said other hand are gripping a golf club whereby pull on either or both of said first and second loops, when said aid is being worn, will indicate to the player that his grip is improper.

2. The aid set forth in claim 1 further characterized in that said loops each have an axis extending therethrough and which axes are parallel to one another.

3. The aid as described in claim 2 further characterized in that said loops have outer ends in respect to said player's hand, which ends lie along a common line.

4. The aid set forth in claim 3 further characterized in that said band, when unassembled, comprises a flat piece of flexible material which has a portion cut away adjacent said aperture to form two spaced apart edges, said edges being securable together to form a curved bow portion that can fit smoothly around said inner edge and thumb of said one hand when said training aid is worn by said player.

5. The aid set forth in claim 2 further characterized in that said band, when unassembled, comprises a flat piece of flexible material which has a portion cut away adjacent said aperture to form two spaced apart edges, said edges being securable together to form a curved bow portion that can fit smoothly around said inner edge and thumb of said one hand when said training aid is worn by said player.

6. The aid set forth in claim 1 further characterized in that said band, when unassembled, comprises a flat piece of flexible material which has a portion cut away adjacent said aperture to form two spaced apart edges, said eges being securable together to form a curved bow portion that can fit smoothly around said inner edge and thumb of said one hand when said training aid is worn by said player.

7. The aid set forth in claim 1 further characterized in that said first and second loops are elastic.

8. A golf training aid of the type to be worn on one hand of a golf player and engageable by the other hand of said player to properly position both hands in relation to each other when gripping a golf club, said hands each having fingers including a middle finger, a thumb, a palm, a back, an outer edge and an inner edge, said training aid including;

a band of flexible material sized to surround said palm, back, outer and inner edges of said one hand, said band having a finger receiving means for accommodating said fingers of said one hand and a first thumb receiving means sized to receive said thumb of said one hand; a second flexible thumb receiving means secured to said band adjacent said first thumb receiving means and located to be in adjacent opposed relation to said palm of said one hand, when said training aid is properly located on said one hand, for snugly receiving therein the thumb of said player's other hand; and wherein the improvement comprises a flexible middle finger receiving means secured to said band in spaced relation from said second flexible thumb receiving means and located in adjacent opposed relation to said outer edge of said one hand when said training aid is properly located on said one hand, said middle finger receiving means sized to snugly receive therein only said middle finger of said player's other hand to properly position said other hand relative to said one hand when said hands are gripping a golf club whereby pull on either or both of said second thumb receiving means or said middle finger receiving means, when said glove is being worn, will indicate to the player that his grip is improper.

9. A golf training aid according to claim 8 characterized in that said second flexible thumb receiving means and said second flexible middle finger receiving means comprise flexible loops.

10. A golf training aid according to claim 9 characterized in that said loops each have an axes extending therethrough, said axes being parallel to each other.

11. A golf training aid according to claim 9 characterized in that said loops each have an outer end with respect to said player's hand, and in that said outer ends lie along a common line.

12. A golf training aid according to claim 9 characterized in that said loops are elastic.

* * * * *